United States Patent [19]

Weitzel

[11] 4,409,273

[45] Oct. 11, 1983

[54] SCRIM FABRIC AND PRODUCT

[75] Inventor: Edward W. Weitzel, Greenville, S.C.

[73] Assignee: Milliken Research Corporation, Spartanburg, S.C.

[21] Appl. No.: 218,736

[22] Filed: Dec. 22, 1980

[51] Int. Cl.[3] ..... B32B 5/12

[52] U.S. Cl. ..... 428/109; 428/105; 428/108; 428/192; 428/212

[58] Field of Search ..... 428/105, 107, 108, 109, 428/110, 111, 112, 113, 121, 192, 212; 139/383 R, 417; 156/439, 440, 177, 181; 28/101, 102

[56] References Cited

U.S. PATENT DOCUMENTS

| | | | |
|---|---|---|---|
| 687,465 | 11/1901 | Taylor | 139/383 R |
| 2,269,321 | 1/1942 | Scheuer | 139/417 |
| 3,608,164 | 9/1971 | Bolles | 156/181 |
| 3,885,279 | 5/1975 | Darnell et al. | 156/439 |
| 4,103,055 | 7/1978 | Levy | 428/259 |

*Primary Examiner*—James J. Bell

*Attorney, Agent, or Firm*—Earle R. Marden; H. William Petry

[57] ABSTRACT

A scrim fabric for use in a mattress to isolate the springs from the matting or foam which is placed under the mattress cover. The scrim fabric has a larger warp end count in the middle third of the fabric to support the heavy portion of the body when the scrim fabric is employed in the mattress.

1 Claim, 7 Drawing Figures

SCRIM FABRIC AND PRODUCT

Scrim fabric has been employed as a reinforcement fabric in a number of applications, such as in laminated sheet products. It is proposed to provide a non-woven, scrim fabric especially adapted for use as a protective fabric between the springs and the foam or wadding layer of a mattress.

It is therefore an object of the invention to provide a new and novel method of manufacturing a non-woven scrim fabric especially adapted for use as a spring mechanical isolation fabric in a mattress.

Other objects and advantages of the invention will become readily apparent as the specification proceeds to describe the invention with reference to the accompanying drawings, in which.

Figure 1:
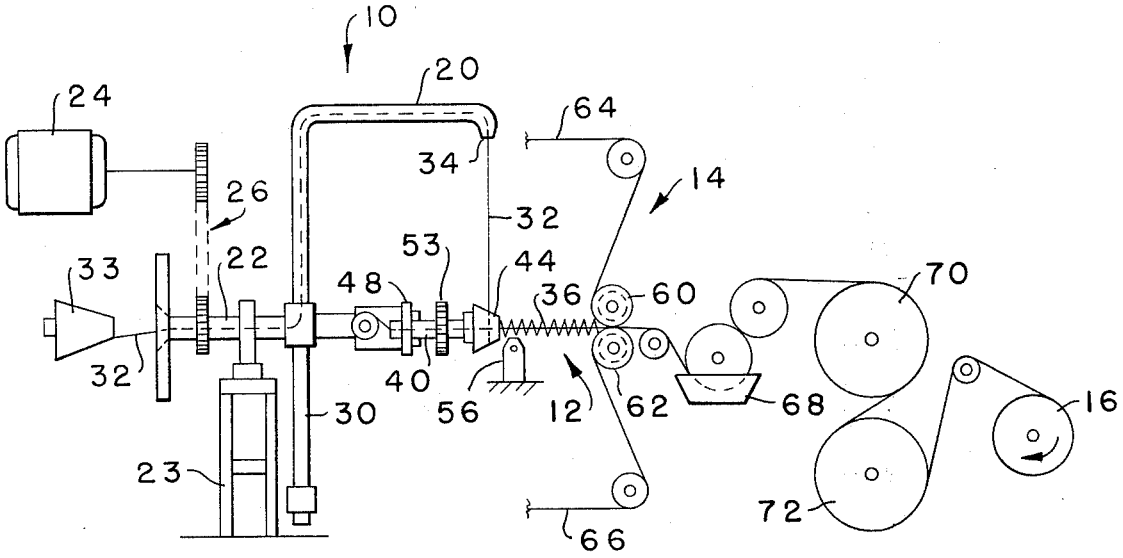
FIG. 1 is a schematic side elevation view of an apparatus for producing non-woven scrim fabrics.

Referring more particularly to the drawings, FIG. 1 shows a schematic side elevation of an apparatus for continuously forming non-woven, net fabrics which generally includes a thread winding section 10, a weft sheet forming section 12, a warp and weft sheet combining section 14, and a take-up roll 16 for collecting the composite non-woven net fabric.

Figure 2:
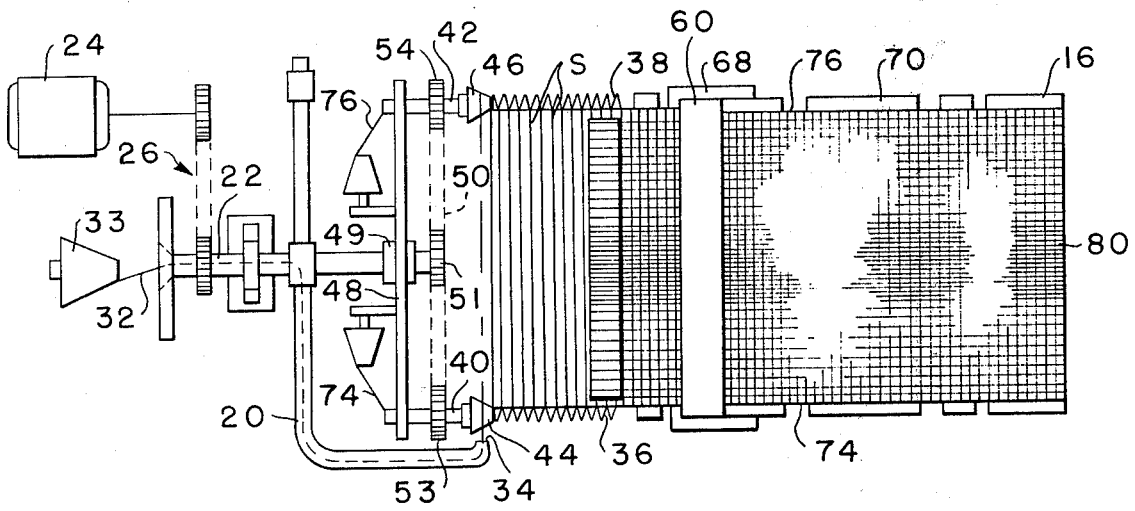
FIG. 2 is a schematic plan view of the apparatus of FIG. 1.

As shown in FIGS. 1 and 2, thread winding section 10 includes thread winding means comprising a hollow tubular thread guide arm 20 secured to a hollow central shaft 22 for rotation therewith. Shaft 22 is suitably supported by a support frame 23 for rotation about its central axis and is rotatably driven by a motor 24, the shaft of which is suitably connected thereto by a chain and sprocket drive assembly 26. Guide arm 20 is appropriately counterbalanced for rotation by a weighted arm 30 and during rotation, a continuous thread 32 is continuously passed from a supply package 33 through the hollow shaft 22, radially outwardly through the tubular arm 20 and through a thread outlet 34 in its outer end.

The weft sheet forming section 12 includes a pair of helically configured, elongate spaced thread support members or springs 36, 38 which are of substantially identical construction and are supported at one end thereof on stub shifts 40, 42. Surrounding the supported ends of the springs 36, 38 are conically shaped thread guide members 44, 46, the function of which will be hereinafter described.

As best seen in FIG. 2, stub shafts 40, 42 are rotatably mounted at opposite ends of a cross arm support member 48 which is supported by a bearing 49 surrounding drive shaft 22. The springs are rotated about their respective longitudinal axes by a sprocket chain 50 (indicated in dash lines) drivingly connecting a central sprocket 51 on drive shaft 22 to sprockets 53, 54 on the respective stub shafts 40, 42. To facilitate positional support of the springs suitably supported blocks or stop members 56 (FIG. 1) are positioned beneath the springs and abuttingly engage the same to prevent rotation of the cross arm 48 and springs 36, 38 about the drive shaft 22 during its rotation.

As the guide arm 20 rotates with the outlet 34 therein describing a circular path about the supported ends of the springs 36, 38, the thread strand 32 passes therefrom and is wound in a continuous manner about the springs to form a plurality of reaches or thread sections S therebetween. As seen, the thread passing from the guide arm is laid onto the conically shaped members 44, 46 surrounding the springs where it then slides down the member and into the adjacent space formed by the first helix of each spring. As the springs rotate the thread loops formed at the ends of each thread section S are engaged by the helices and advanced along the springs in spaced, generally parallel relation to form a weft sheet. The relation of the threads in the weft sheet is best seen in FIG. 2. As shown in FIGS. 1 and 2, the thread guide arm 20 is displaced at 90° angles of its rotational travel about the springs to show the manner in which the thread 32 is wound thereon.

As seen in FIGS. 1 and 2, the warp and weft sheet combining section 14 includes a pair of rolls 60, 62 which are rotatably supported by suitable means, not shown, between the free or open ends of the springs 36, 38. As the thread sections being advanced along the rotating springs 36, 38 approach the open ends of the springs they pass between and are engaged by the rolls 60, 62. One or more sheets 64, 66 of warp threads are supplied continuously to the rolls 60, 62 from a suitable source such as warp beams, not shown, and, during their movement therethrough, the warp and weft sheets are brought into contiguous coplanar relation. The combined sheets pass over a guide roller and through a rigid plastisol adhesive bath 68 where a suitable adhesive is applied thereto. The sheet thereafter passes about the surface of heated drying rolls 70, 72 where the adhesive is dried and cured to secure the warp and weft sheets together and the thus formed non-woven net fabric is accumulated on the collection roll 16. Although not shown, one or more of the rolls in the warp and weft sheet combining section 14 may be suitably driven to move the sheets through the apparatus.

To facilitate support and positioning of the weft sheet during its passage through the apparatus, selvage threads 74, 76 are supplied from packages mounted on the cross arm 48 (FIG. 2) and pass through central passageways in the stub shaft 40, 42 and the longitudinal axes of the springs to be positioned within the loop ends of the weft thread sections. The selvage threads strengthen the composite non-woven net product and provide additional support to the weft sheet during its passage through the final sections of the apparatus.

Figure 3:
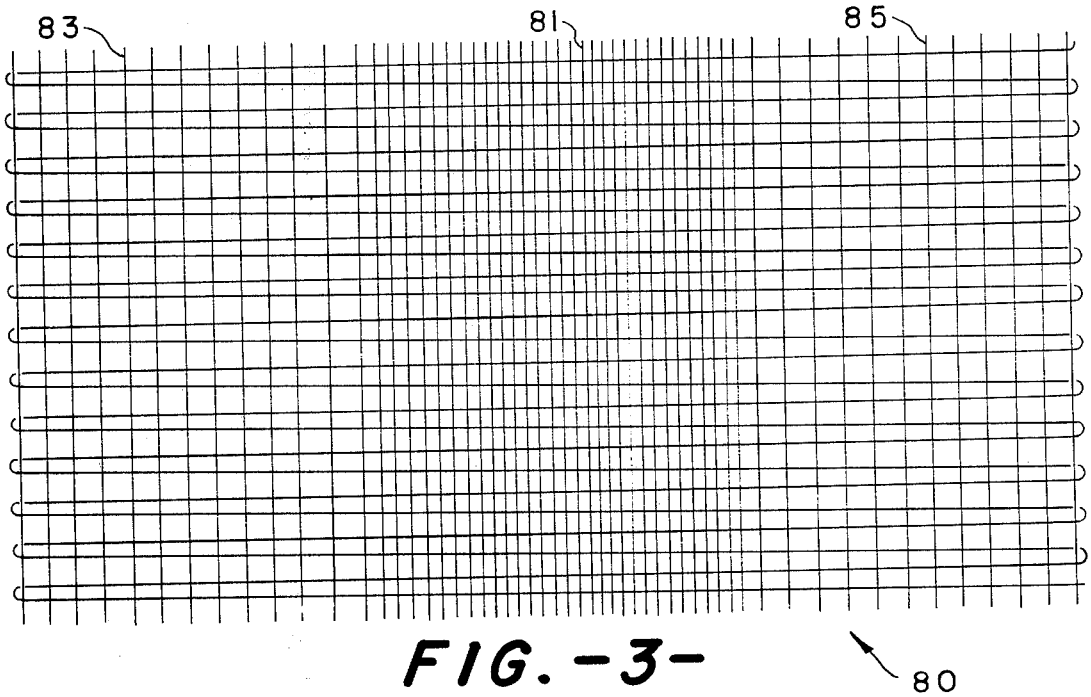
FIG. 3 is an enlarged schematic view of the new and improved scrim fabric.
Figure 4:
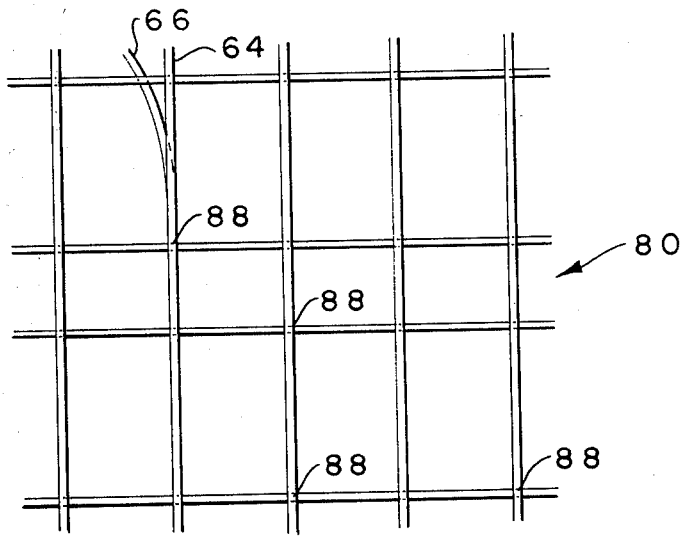
FIG. 4 is an enlarged view of a portion of the fabric shown in FIG. 3.
Figure 5:
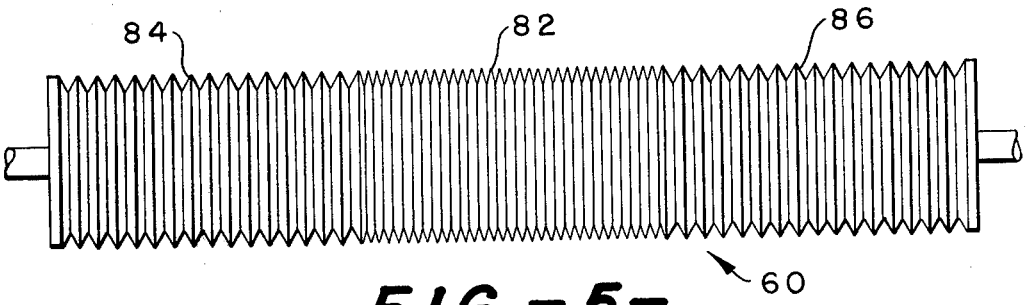
FIG. 5 is a view of the warp yarn guide roll.
Figure 6:
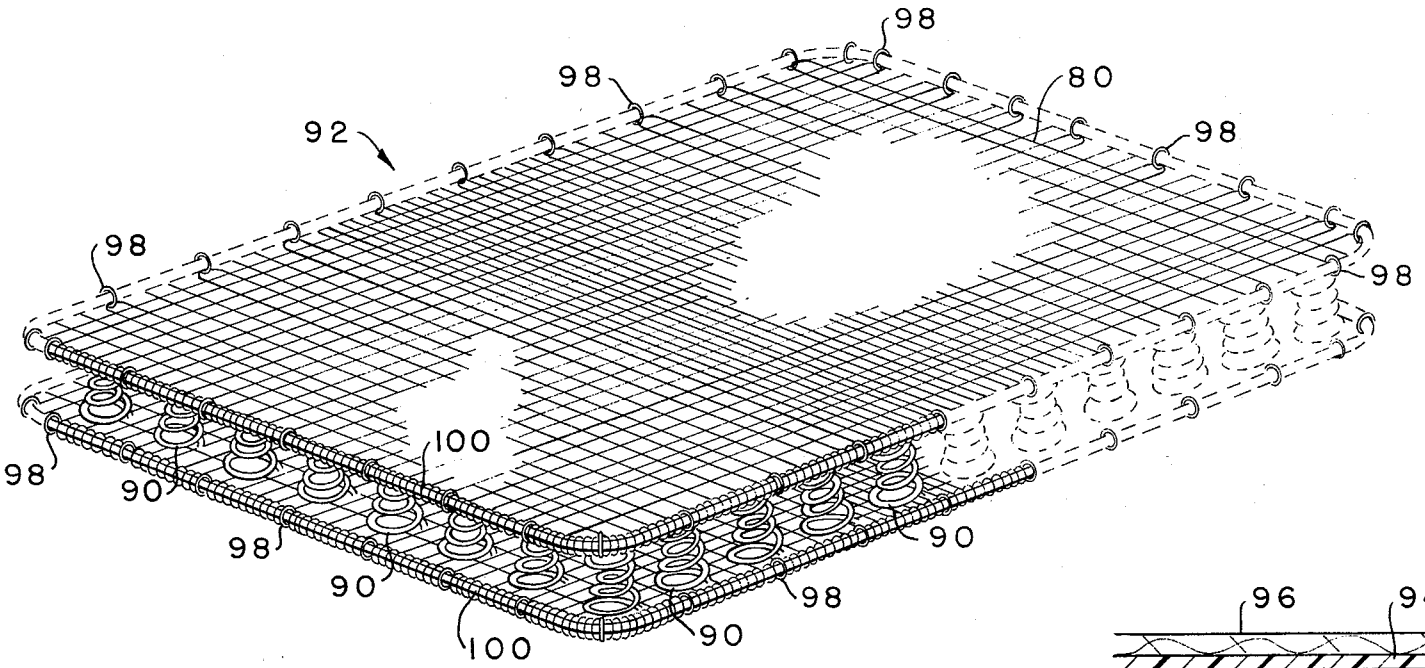
FIG. 6 is a perspective view of a new mattress construction.
Figure 7:
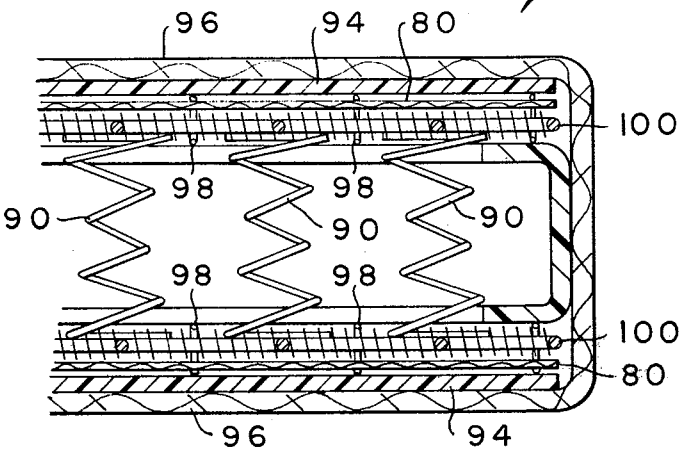
FIG. 7 is a cross-section view of the mattress shown in FIG. 6.

As shown in FIG. 2 and in more detail in FIGS. 3 and 4, the non-woven scrim fabric 80 produced has a warp end count in the middle third 81 of the fabric which is twice the end count of the outer thirds 83 and 85 of the fabric. This is accomplished by having the rolls 60 and 62 (FIGS. 1, 2 and 5) grooved so that each groove in the roll guides a single warp yarn. As shown in FIG. 5, the center 82 of the roll has twice the number of grooves per inch as the extremities 84 and 86. The rolls 60 and 62 are mounted so that the grooves in the roll 60 mate with the rolls 62 so that the warp yarn in the sheet 64 mates with the warp yarn in the sheet 66 to provide a strong bond with the filling yarn 32 at the cross-over points 88.

As discussed briefly, the fabric 80 is designed primarily for use as a spring reinforcing fabric in a mattress. In the particular application, the width of the fabric 80 is 80″ and is shipped on rolls 16 so that it can be cut to size. In the specific disclosed fabric, the warp yarn is a 500 denier polyester, multifilament yarn and the fill yarn is a 1000 denier multifilament, polyester yarn. The warp construction is a one-over-one construction with the center portion 81 being 26″ wide with four warp ends per inch while the outer portions are each 27″ wide with an end count of two warp ends per inch. The filling yarn is one pick per inch.

In use, the fabric 80 is placed over both sides of the springs 90 of a mattress 92 with the warp yarns lying across the width of the mattress and the ends of the fill yarn being the head and foot end of the mattress. Since the fabric is 80″ wide, this will fit the length of most conventional mattresses, and the warp length can be cut to the width of the desired size mattress. It should be noted that the center portions 81 with the high warp end count will be across the center of the mattress to provide extra support for the heaviest portion of the body.

The mattress construction is conventional in that the foam or stuffing 94 is located on both sides of the scrim fabric 80 and covered with a conventional mattress ticking 96. The scrim fabric 80 is held in place by the use of hog rings 98 which engage the fabric 80 and clamp it to the rods 100 which secure the springs 90 in position relative to one another.

It can be seen that a new and novel non-woven, scrim fabric has been described which, with its unusual construction, provides an economical and efficient fabric to effectively reinforce the springs in a mattress.

Although I have described the specific embodiment of the invention, it is contemplated that changes may be made without departing from the scope or spirit of the invention, and I desire to be limited only by the scope of the claims.

I claim:

1. A non-woven synthetic fabric comprising: a plurality of polyester fill yarns, a plurality of polyester warp yarns extending over and adhered to the fill yarns in a direction substantially perpendicular thereto, a plurality of polyester warp yarns extending under and adhered to the fill yarns and the warp yarns extending over the fill yarns, the end count of the warp yarns in the center of the fabric being at least twice the end count of the warp yarns at the extremities of the fabric.

* * * * *